United States Patent [19]

Nelson

[11] 4,150,606

[45] Apr. 24, 1979

[54] AUTOMATIC LABORATORY FUME HOOD SASH OPERATOR

[76] Inventor: Laurence N. Nelson, R.R. #1, Onsted, Mich. 49265

[21] Appl. No.: 810,762

[22] Filed: Jun. 28, 1977

[51] Int. Cl.[2] ..... F23J 11/00

[52] U.S. Cl. ..... 98/115 LH; 49/349; 49/357; 49/360; 55/DIG. 18; 422/104

[58] Field of Search ..... 49/349, 352, 354, 357, 49/360; 98/115 LH, 115 R; 55/DIG. 18; 23/292; 128/1 B; 200/61.62

[56] References Cited

U.S. PATENT DOCUMENTS

| | | | |
|---|---|---|---|
| 3,025,780 | 3/1962 | Russell | 98/115 LH |
| 3,403,474 | 10/1968 | Spasoff | 49/360 |
| 3,531,895 | 10/1970 | Appell | 49/360 |
| 3,714,372 | 2/1973 | Fillion | 49/360 |
| 3,934,496 | 1/1976 | Turko | 98/115 LH |
| 3,938,282 | 2/1976 | Goyal | 49/360 |
| 4,050,189 | 9/1977 | Peterson | 49/360 |

*Primary Examiner*—Ronald C. Capossela

*Attorney, Agent, or Firm*—Hill, Gross, Simpson, Van Santen, Steadman, Chiara & Simpson

[57] ABSTRACT

An attachment for laboratory fume hood structures and the like for opening and closing the movable sash member thereof to vary or close the effective size of such access opening, and in particular to move the sash into closed position when the hood is unattended and to open the hood in the presence of operating personnel. The construction is such that the device may be readily attached to most existing fume hood structures and the like with substantially no modification or change in the latter and providing automatic operation when desired as well as manually controlled operation. At the same time the construction is such that the sash member may be manually actuated if necessary. A further improvement provides for the control of the hood exhaust blower, for example to provide high speed operation when the sash is in open position and low speed operation when the sash is in a lowered or closed operation and, if desired, simultaneously therewith the control of an auxiliary air blower.

20 Claims, 5 Drawing Figures

Fig. 1
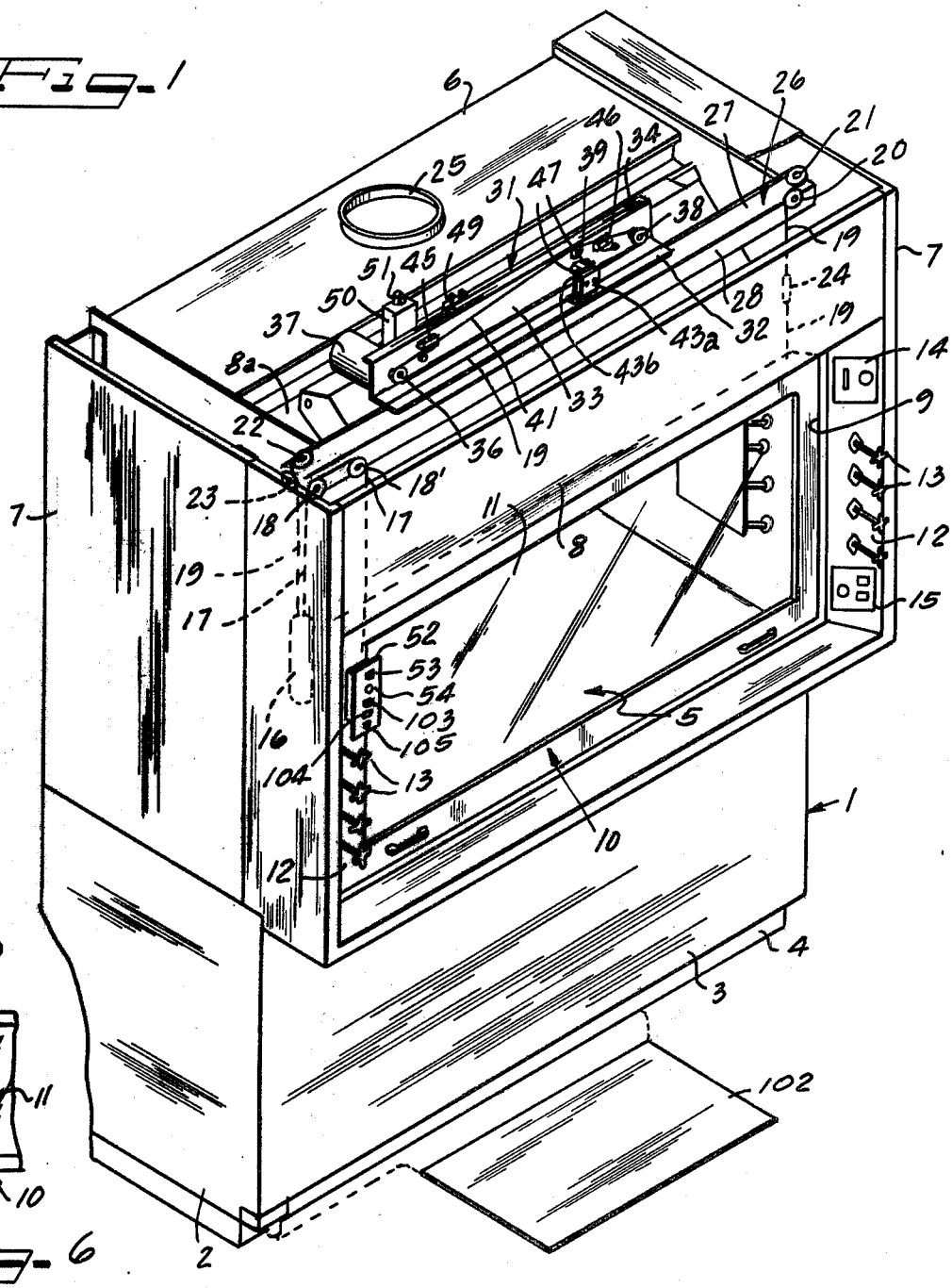
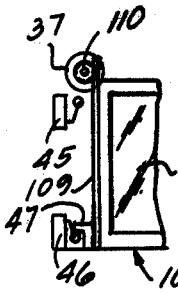
Fig. 6
Fig. 2
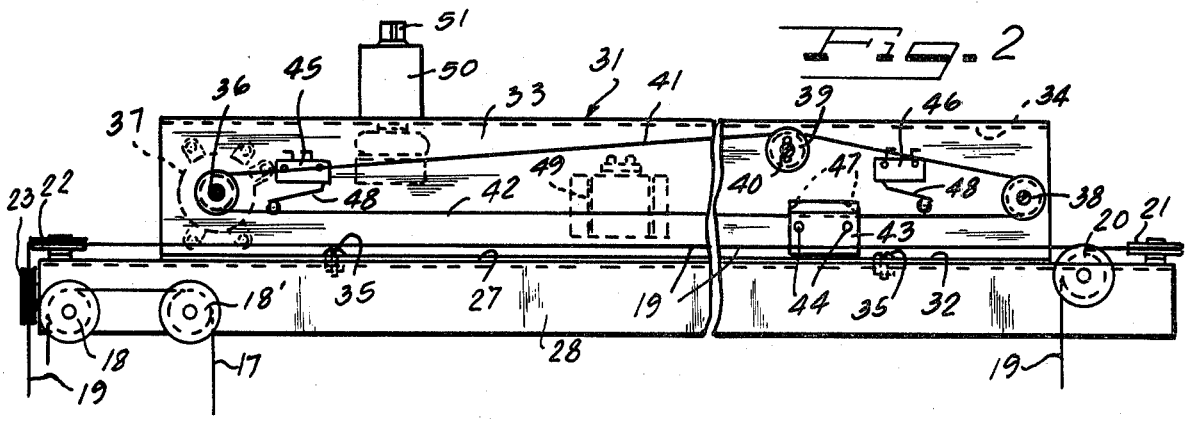

Fig. 3
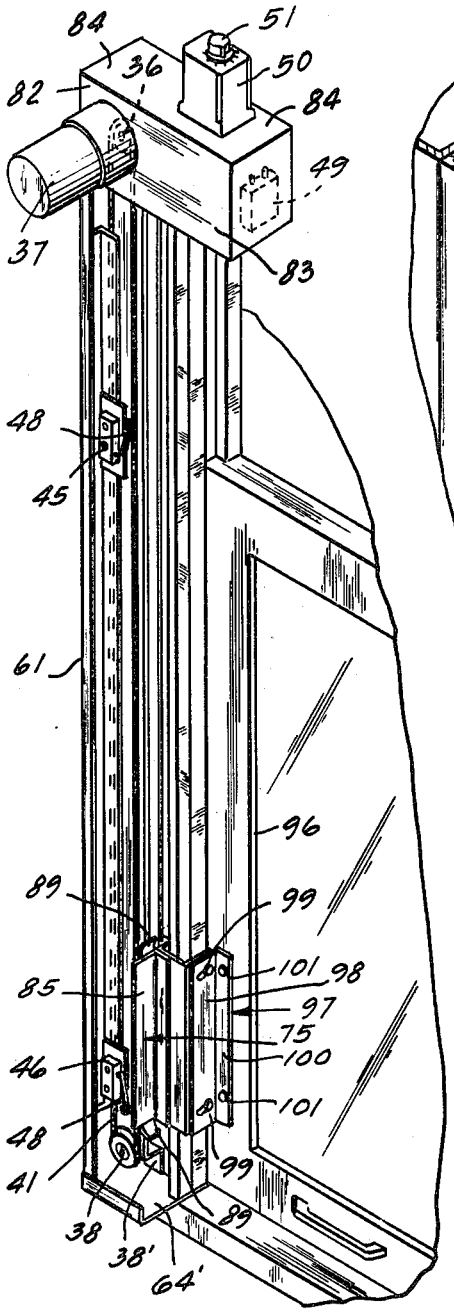
Fig. 4
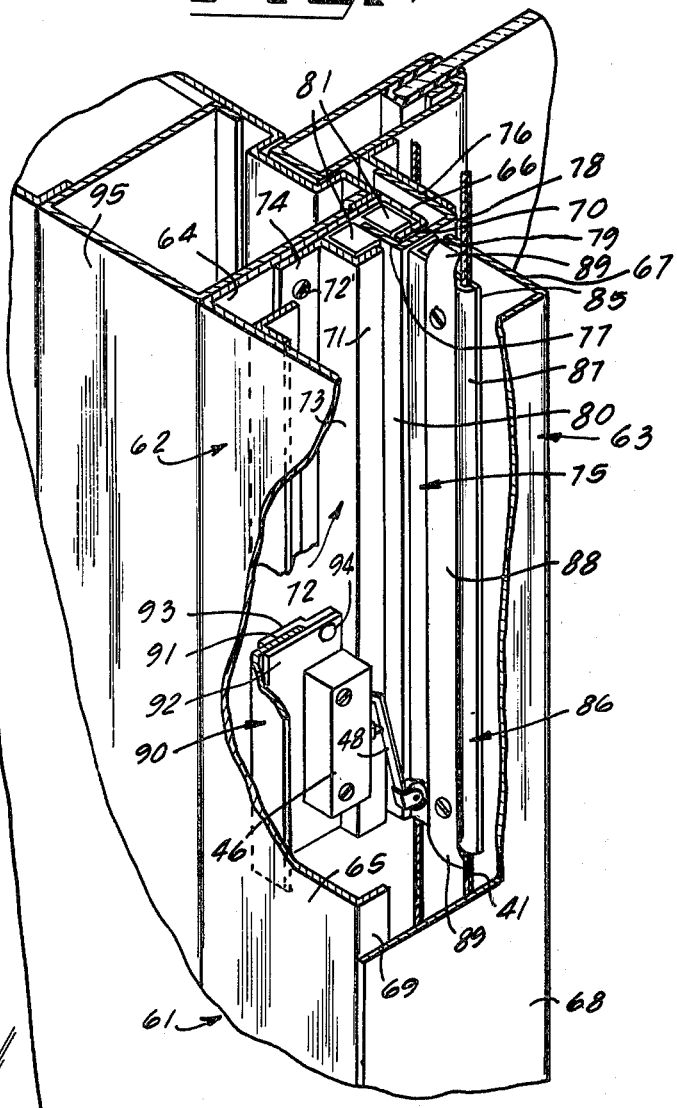
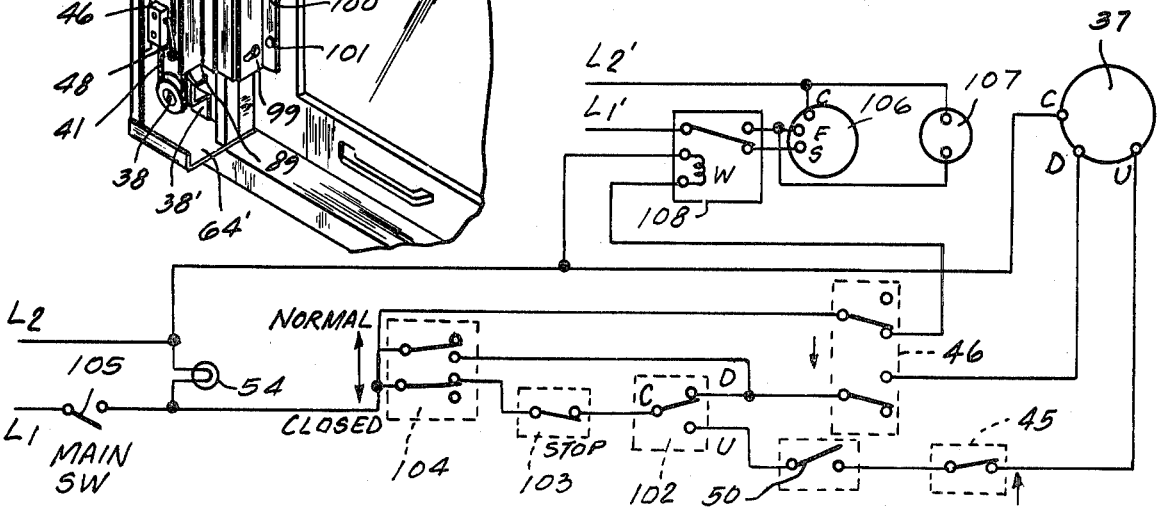
Fig. 5

AUTOMATIC LABORATORY FUME HOOD SASH OPERATOR

BACKGROUND OF THE INVENTION

Fume hoods have been used in laboratories and other places for many years and, in general, employ a bench structure having a work surface upon which is disposed an enclosing hood structure, the front side wall of which is formed, at least in part, by an upwardly movable sash member, usually having a glass panel through which the interior of the hood may be viewed, and which member may be disposed in a closed position or may be suitably raised to an open position to provide a desired amount of access to the interior. In most instances, the sash member is counterbalanced for ease of operation, and at the same time retaining the sash member in any desired open position.

In use, air is exhausted from the hood enclosure by means of a suitable exhaust blower or the like to withdraw obnoxious or dangerous gases, etc. created within the hood, with air being admitted through the access opening to maintain a control velocity through the open face of the hood structure to prevent any contaminated air from escaping into the room in which the hood is disposed. In some cases the entire air withdrawn may be supplied through the access opening from the room air, while in other installations an auxiliary air supply and air blower are provided for supplying air to the hood and thus reduce the total volume of air withdrawn from the room. For example, assuming an exhaust of 1,000 CFM of air, with a 70% auxiliary air ratio, 700 CFM would be supplied by the auxiliary air supply and only 300 CFM by the room.

Where a single speed exhaust blower, with or without an auxiliary air blower is employed a relatively large volume of air is being continually exhausted, with all or at least a part thereof being withdrawn from the room interior. If a number of hoods are in a room the loss is accordingly multiplied. Where such room interior is either heated or air conditioned, obviously the loss of a large volume of room air entails a corresponding loss in energy involved in the supply of such air, and if the volume of air could be materially decreased when not required, a considerable saving in operating costs could be achieved.

BRIEF SUMMARY OF THE INVENTION

The present invention is directed to a structure for controlling the size of the access opening in dependence upon the presence or absence of operating personnel, whereby the sash member of the fume hood may be moved into closed position when the hood is unattended, and raised to an elevated position to provide the desired access opening in the presence of operating personnel. Likewise, the closure of the hood when unattended provides additional protection to other personnel in the same room from runaway reactions, explosions, etc. that might take place in the unattended hood.

While the device may be incorporated in new hoods, it is so designed that it may be readily incorporated with most existing fume hood structures, occupying little space and providing automatic control of the access opening. If desired, in conjunction therewith the device may include means for controlling the operation of an exhaust blower, for example a two-speed blower, and/or an auxiliary air blower.

In the embodiment of the invention illustrated, cable loop is provided which carries an actuating member which is movable along a line of travel, with the cable being operatively connected to an electric motor or the like for effecting such movement. The mechanism may be carried by a base structure which is adapted to be suitably positioned on the fume hood with the line of travel of the actuating member extending parallel to the line of travel of a movable element of the closure structure, whereby upon connection of the actuating member with such movable element, the sash member of the closure structure will be raised or lowered in correspondence to the movement of the actuating member. Two embodiments of the invention are illustrated, in one of which the actuating element is connected with a cable associated with counter-balancing means for the movable sash member of the enclosure structure, and in the other embodiment, the actuating element is connected directly to the closure member, i.e. to the frame of the sash member.

Limit switches may be suitably provided, for example, operatively disposed in the path of the actuating element, for actuation thereby at either end of the operative travel of the opening and closing movements of the sash member to control the operation of the electric motor of the attachment and limit travel of the sash member.

The operation of the attachment, and thus the control of the sash member of the closure structure, may be controlled in response to the presence or absence of operating personnel by any one of a plurality of different switch mechanisms, for example, a rubber floor switch mat, a proximity switch, automatically or manually actuatable mechanical means or by means of a photo electric eye and associated system. Likewise, to prevent undesired operation resulting from personnel traffic across the front of the hood, a suitable time delay may be included, providing a sufficient delay to prevent actuation of the system by such transient personnel. Also, suitable guard rails may be provided to obstruct an actuating passage across the front of the fume hood. The electrical circuits may include relay means for also operating a two-speed exhaust blower and/or an auxiliary air blower, whereby, in addition to controlling the opening or closing of the sash member, the high-low speed operation of the exhaust blower may also be controlled so that it will be operated at high speed when the sash member is in a raised position and operated at a lower speed when the sash member is in a lowered or closed position. If an auxiliary air blower is also provided, it may be suitably connected to operate, for example, only when the exhaust blower is operating at high speed. Preferably the arrangement is such that in the event of a failure of the control circuits high speed exhaust will be maintained, assuring a fail-safe operation.

While the use of auxiliary air will reduce the quantity of conditioned room air withdrawn during operation of the fume hood, the auxiliary air is normally supplied at 70° F. and may require heating to such temperature. Consequently, by effecting a discontinuance of the flow of auxiliary air, a saving is further effected with respect to such heating thereof.

Where a fume hood, not initially designed for operation with auxiliary air is provided therewith, the invention can be utilized to enable the discontinuance of auxiliary air flow and reduction in speed of the exhaust blower, thereby eliminating the necessity of modifying the hood structure (otherwise required) to incorporate a by pass to capture the auxiliary air when the sash member is in a closed position. When desired, adjustment can be effected to limit the closing movement of the sash member to provide a minimum opening for air flow into the hood.

In addition, manual switch means may be provided for stopping the sash member at any desired point along its travel as well as moving the sash member into its closed position irrespective of the presence of personnel, and thus eliminating the automatic operation.

The construction also is such that failure of the device will not preclude manual actuation of the closure member.

BRIEF DESCRIPTION OF THE DRAWINGS

In the drawings wherein like reference characters indicate like or corresponding parts, FIG. 1 is an isometric view of a fume hood, of generally standard construction, illustrating the mounting thereon of an attachment in accordance with the present invention;

FIG. 2 is a front elevational view of the attachment illustrated in FIG. 1;

FIG. 3 is an isometric view of a portion of a fume hood structure, illustrating a further embodiment of the invention adapted to be connected directly to the movable sash member of the hood structure;

FIG. 4 is an isometric view in transverse cross-section of the structure illustrated in FIG. 3;

FIG. 5 is a wiring diagram illustrating a circuit for the control of both a closure member, exhaust blower and auxiliary air blower in accordance with the invention; and FIG. 6 is a front elevational fragmentary view of a modified actuator structure utilizing a rack and pinion arrangement.

DETAILED DESCRIPTION OF THE INVENTION

Referring to the drawings and more particularly to FIG. 1, there is illustrated a conventional type laboratory fume hood structure upon which the operator attachment, constructed in accordance with the present invention, is mounted.

The laboratory fume hood illustrated comprises a base structure indicated generally by the reference numeral 1 which includes a pair of end walls 2, only one of which is illustrated in FIG. 1, and a front wall 3, illustrated as having an inwardly offset bottom portion 4. At the top of the base portion 1 is a work surface 5 which is enclosed by a hood structure having a top wall 6, double wall structures 7, and a rear wall, not illustrated. A front wall 8 and 8*a* extends across the upper portion of the front of the hood, defining an access opening 9 which is provided with a vertically movable closure member 10, illustrated as being in the form of a sash member having a transparent window 11 therein. The side and bottom portions of the hood structure adjacent the access opening 9 are provided with respective facia panels 12, the side panels of which may be provided with controls 13 and other accessory means such as switch, electrical outlet and pilot light panels 14 and 15 for the control of the equipment of the fume hood.

Hoods such as illustrated in FIG. 1 are normally provided with counterbalancing means for the movable sash disposed in the access opening and, in the structure illustrated, the sash is adapted to be counter-balanced by a weight 16 which is connected by a cable 17 to the left-hand side of the sash 10, with such cable extending upwardly from the weight 16 and over a pulley 18 and 18', freely rotatable on respective horizontal axes, and from the pulley 18', down to the sash. In like manner, the right-hand side of the sash is connected by a cable 19 to the sash weight 16, with the cable extending from the sash over a pulley 20, freely rotatable on a horizontal axis, from which the cable extends partially around a second pulley 21, freely rotatable about a vertical axis. The cable then extends horizontally across the top of the hood structure, passing partially around another pulley 22, which is freely rotatable on a vertical axis, and from there over a pulley 23, also freely rotatable about a horizontal axis, and from there down to the sash weight 16. Relative adjustment between cables 17 and 19 may be achieved by suitable means, as for example, a turn buckle 24 illustrated as being inserted in the vertical portion of the cable 19 adjacent the right-hand side of the sash, whereby the length of the respective cables may be adjusted relative to one another to insure accurate positioning of the sash member 10.

The structure shown is merely illustrative to permit adequate explanation of the invention to such a fume hood structure.

The top of the hood is provided with an air discharge outlet 25 which may be suitably connected to an exhasut duct and an exhaust blower which, in the hood structure illustrated, would be external thereto.

The sash operator attachment

FIGS. 1 and 2 illustrate a first embodiment of the invention, for use with a fume hood such as that illustrated, employing a sash balancing counterweight and cable structure.

The reference numeral 31 refers generally to a base member or support member, illustrated as being in the form of a ZEE member which, as clearly illustrated in FIG. 1, comprises a horizontally extending base flange 32 extending at its inner edge from a longitudinally extending intermediate vertical wall 33 which terminates at its upper edge in a rearwardly extending flange 34. The member 31 is adapted to be connected to a suitable horizontally extending portion of the hood structure, as for example a horizontally extending member 26, illustrated as being in the form of an angle member having a top surface 27 and a downwardly extending wall 28. The base member 31 may be mounted by suitable means as for example screws 35 extending through the lower flange 32 and into the top wall 27 of the member 26.

Disposed adjacent the intermediate wall 33 is a drive pulley 36, mounted on the drive shaft of a motor 36 secured to the wall 33, an idler pulley 38 and a tensioning pulley 39, with the pulleys 38 and 39 being freely rotatable about axes extending parallel to the axis of the pulley 36. As illustrated in FIG. 2, the pulley 39 has its support shaft 40 secured to the wall 33 for vertical adjustment, whereby the axis of the pulley can be raised or lowered to adequately adjust the tension of a cable 41, which extends over the respective pulleys and has a horizontally extending bottom portion 42 which is secured to an actuating member 43, with the latter thus being movable along a horizontal line of travel as the cable is moved by the drive pulley 36 driven by the motor 37.

As illustrated in both FIGS. 1 and 2, the actuating member 43 is adapted to be secured to the horizontally extending portion of the sash balance cable 19, whereby the latter will move along with the actuator 43, the cable portions 19 and 42 being parallel to one another. The actuating member conveniently may be made in two sections 43*a* and 43*b*, suitably connected by screws 44 whereby both cables 19 and 41 may be firmly clamped therebetween. The operation of the motor 37 is controlled, at the respective ends of the desired travel, by limit switches 45 and 56 which are cooperable with ramp portions 47 on the actuating element 43 to cam the actuating arms 48 of the respective microswitches into switch-opening positions at the corresponding ends of travel. The microswitches, may be mounted on the wall 33 for lateral adjustment, if necessary, to insure that the sash member will be in the desired open or closed positions when the associated limit switch is open. As illustrated, other components of the attachment, such as a capacitor 49 and a delay device 50, which may have a delay adjustment knob 51, may be suitably carried by the base member, for example from the rear wall thereof as illustrated. Also, as illustrated, a control panel 52 may be provided which, as hereinafter described, may have a plurality of control switches thereon as well as a switch 53 for actuating an illuminating light within the fume hood and pilot light 54 indicating that the attachment is in operation.

Modified construction of FIGS. 3 and 4

While a large number of fume hoods, currently in use, are constructed in a manner generally corresponding to that of FIGS. 1 and 2, some fume hood structures do not incorporate a construction having a counterbalancing system which is readily accessible for connection to the actuating element of the attachment and, consequently, the attachment illustrated in FIGS. 1 and 2 is not suitable for use in such type of fume hood structures.

In such cases a construction such as illustrated in FIGS. 3 and 4 may be employed, in which the attachment is adapted to be mounted along a vertical side wall of the fume hood structure, with the actuating element being adapted to be connected directly to the sash member for direct transfer of movement from the actuating member to the sash member.

Referring to FIGS. 3 and 4, the supporting or base member, indicated generally by the numeral 61, is constructed in two sections, a main or base section 62 and a cover section 63. The base section 62 is provided with a rear wall 64, an exterior side wall 65, and the inner portion 66 of the laterally inner side wall, the remainder of which is formed by the wall portion 67 of the section 63, which is also provided with a front wall 68, the latter being secured to a cooperable flange 69 at the outer edge of the outer side wall 65 of the section 62.

As illustrated in FIG. 4, the side wall portion 66 terminates along its outer edge in an inwardly directed flange 70 which is aligned with a flange 71 forming one wall of a ZEE member 72, which is provided with an intermediate wall 73, generally corresponding to the wall 66 of the support member, the inner edge of the wall 71 terminating in the outwardly directed flange 74 which is suitably secured, as for example by means of screws and nuts 72' to the wall 64 of the base member.

The actuating member, indicated generally by the reference numeral 75, is of generally U-shaped configuration in transverse cross-section having an outer leg portion 76, and an inner leg portion 77 extending parallel thereto, which is connected by a transversally extending intermediate portion 78, with the latter extending through the slot 79 defined by the inner side wall portions 66 and 67, and the leg portions 77 extending through the slot 80 defined by the flange 70 of the base or supporting section 62 and the flange 71 of the ZEE member 72. The ZEE member 72 and adjacent corner of the base section 62, including the flange 70, thus form a guide channel for the actuating member 75 which, as illustrated in FIG. 4, has secured thereto two bars 81, of nylon, or other suitable material which are substantially coextensive with the actuating member and secured thereto by screws or the like, at opposite sides of the wall 77 with the actuating assembly of the member 75 and bars 81 being dimensioned to provide a smooth sliding fit between the actuating member and the guide structure. The lengths of the portion 77 of the actuating element 75 and bars 81 are such that any cocking or binding action between the actuating member and the guide structure is substantially eliminated, providing smooth, easy movement therebetween. The length of the guide structure may be merely sufficient to insure that the actuating member is adequately guided therein throughout the length of its travel.

As illustrated in FIG. 3, the support section 62 may terminate at the bottom end thereof in a suitably formed bottom wall 64' which may be integrally formed from stock of the section, while the upper end is provided with a motor support member 82 of generally angular configuration having a front wall 83 and a top wall 84, with the member 82 being suitably secured to the top end of the base structure by suitable means, as for example welding, with the front wall 83 thereof carrying the motor 37 which is provided with a drive pulley 36, cooperable with an idling pulley 38 mounted on a support bracket 38' carried by the rear wall 64, with a cable 41 extending around the pulleys 36 and 38 with the cable being secured to the actuating member 75.

As illustrated in FIG. 4, secured to and extending outwardly from the intermediate wall 78 of the actuating member is an angle member 85 which is cooperable with a clamp member indicated generally by the reference numeral 86 to clamp the cable 41 between the angle 85 and the semi-tubular portion 87 of the member 86. As illustrated, the upper and lower ends of the generally flat portion 88 of the member 86 terminate in angled or curved portions 89 which form cams for respective upper and lower limit switches 45 and 46, each of which is supported from an angle member 90 secured to the wall 65, having an inwardly directed wall 91, adapted to be clamped between a flat plate 92 and an offset clamp member 93, with the angle member 90 being adapted to be rigidly secured to the wall 91 by suitable means such as screws 94 only one of which is illustrated. Each limit switch is carried by a respective clamping structure such as described, with the respective actuating arms 48 of the limit switches being adapted to be moved into switch-actuating position by the cam portions 89. The back of the motor support member 82 may be closed by a suitably shaped cover member, not illustrated.

In operation, the attachment of FIGS. 3 and 4 may be mounted on the vertical jamb 95 of a hood structure, with the actuating element 75 extending adjacent the sash 96 of the hood and secured thereto by a bracket member 97 which, as illustrated, may be in the form of an angle having a leg or wall 98 extending parallel to the leg 76 of the actuating member and secured thereto by suitable means such as screws 99 which pass through horizontally extending slots in the wall 98 and are threaed into the adjacent wall 76 of the actuating member. The other wall 100 of the bracket 97 may be secured by suitable means, such as screws 101, to the adjacent portion of the sash 96, the slotted adjustment of the bracket relative to the actuating member enabling movement of the wall 100 into flush engagement with the base of the sash 96.

Thus, the portion of the cable 41, to which the actuating element 75 is secured, extends in a vertical direction parallel to the direction of movement of the sash 96 whereby movement of the cable will result in a raising or lowering of the sash.

The electrical controls

FIG. 5 illustrates the wiring diagram of a suitable circuit for operation of the attachment, in which the motor 37 is of the reversing type, having a common terminal C, an "up" terminal U and a "down" terminal D which, in the embodiment illustrated, may be directly actuated through the mat switch 102, illustrated as being of a single-pole double-throw type. The rest contact D thereof is connected to the corresponding terminal D of the motor in series with the "down" limit switch 46, illustrated as being a double-pole, double-throw switch the lower pole of which, in its unactuated condition, operatively connects the switch 102 with the motor 37. In like manner, the other terminal U of the switch 102 is connected in series with the timer 50 and the "up" limit switch 45 to the "up" terminal U of the motor 37, with the common terminal C of the latter being connected to one side $L_2$ of the power line $L_1$–$L_2$. The opposite side $L_1$ of the power line is connected to the movable terminal C of switch 102 in series with switches 103 and 104.

Switch 103 is illustrated as a single-pole on-off switch, and the switch 104 is illustrated as a double-pole double-throw switch, the movable contacts of which are connected to the line $L_1$ over the main or master switch 105, while the rest contact of the lower pole of the switch 104 is connected to the terminal C of the switch 102 over the switch 103.

Initially, assuming that the master switch 105 is closed, which may be indicated by illumination of the pilot lamp 54, FIG. 5 illustrates the various switches in their positions for normal operation and in the absence of a person standing on the switch 102, whereby the sash member is in "down" position. Switches 103 and 104 may be disregarded for normal function, whereby the main switch 105 may be considered as directly connecting power from the line $L_1$ to the mat switch 102.

In the event of actuation of the switch 102 by a person standing thereon, the supply circuit to the "up" terminal U of the motor 37 will be completed and the motor will rotate in a direction to raise the associated sash member. This will continue until the limit switch 45 is actuated stopping the motor with the sash member in its "upper" open position.

In the event it is desired to move the sash member to its "down" position, even though the switch 102 is actuated, the switch 104 may be actuated, thereby bypassing switch 102 and directly supplying power to the motor 37 over limit switch 46, to move the sash member downwardly until such switch is opened thereby.

Likewise, it may be desired to only move the sash member to a partially open position, i.e. to move the same to an intermediate position. This may be accomplished by suitable actuation of the switch 103. Thus, if the sash member is in a "down" position, (and switch 104 in normal position) upon actuation of switch 102 in response to the presence of a person thereon, the sash member will, after such delay as provided by the timer 50, begin to move upwardly. When the sash member has reached the desired position switch 103 may be opened thereby stopping the motor 37.

It will be noted that the switch 104 still may be operated to close the partially open sash member.

In the event it is desired to move the sash member from a fully open position (switch 102 actuated) to an intermediate position, this may be accomplished by suitable actuation of switches 103 and 104. In this case the switch 103 may be initially actuated to open position, followed by actuation of the switch 104, causing the sash member to move downwardly. When the sash member is in the desired intermediate position the switch 104 is returned to its "normal" position, causing the motor to stop.

The sash member may be returned to fully open position by return of the switch 103 to its normal position, or to fully closed position by reactuating switch 104.

Advantageously, with relatively minor additions, the control circuit may be utilized to control an exhaust blower motor 106 and/or an auxiliary air blower 107, which are adapted to be controlled by a single pole, double throw relay 108 having an actuating winding w, which is connected at one side to the line $L_2$. The motor 106 is illustrated as being of a two-speed type having a common winding C connected to a line $L_2'$, which may be the same or another power supply line, and the opposite side $L_1'$ of such supply line is connected to the movable contact of the relay 108. The rest terminal of the latter is connected to the "high speed" terminal F of the motor 106, while the actuated contact is connected to the "slow speed" terminal S thereof. One terminal of the auxiliary air blower 107 is connected to the rest contact of the relay, and the other terminal thereof to the line $L_2'$ whereby such motor will be actuated when the motor 106 is operating at its higher speed.

The other side of the winding w of the relay 108 may be operatively connected to the first mentioned line $L_1$ over the upper contacts of the upper pole of the limit switch 46, the movable contact of which is illustrated as being connected to line $L_1$ and the actuatable contact connected to the relay winding w.

Assuming the hood is unattended, with the sash member in its closed position and the various switches in the positions illustrated, the winding w of the relay 108 will be energized over the closed contacts of the upper pole of limit switch 46, thus connecting the associated power supply line $L_1$ to the winding to energize the relay and thus supply power to the slow speed terminal S of the motor 106. The exhaust system is thus operating at slow speed with the auxiliary air shut off (motor 107 inoperative) and the sash of the fume hood in its down or closed position. In such cases, the fume hood involved will normally be provided with suitable by-pass vents or openings for admitting the requisite amount of minimum air into the fume hood to assure adequate exhaust operations. When the fume hood is in use, with the sash member raised out of its closed position, the limit switch 46 will be in its rest position with the contacts of the upper pole in open condition. The relay 108 is therefore de-energized and power is thereby supplied to the high speed terminal F of the two-speed blower 106 and the auxiliary air blower 107 is operating.

In the event the motor 37 has an external capacitor 49 associated therewith, this may be mounted on either the base member 31 of the construction illustrated in FIG. 1, or the member 82 of the construction illustrated in FIG. 3.

While the actuation of the limit switch 46 may take place when the sash member reaches its fully closed position, in some instances it may be desirable to so adjust the limit switch 46 that it will be actuated shortly prior to the sash member reaching its fully closed position to allow a small opening to remain, for supplying air to the hood interior.

It will also be appreciated that while the switch 102 has been shown, for the purposes of illustration, as a floor or mat switch adapted to be actuated by personnel standing thereon, the switch 102 could be of any suitable construction and could, for example, be light-responsive or could be in the form of a suitable proximity switch, which would be actuated in the presence of personnel and deactuated in their absence, and employing, for example, single pole, double-throw switch contacts, as illustrated.

FIG. 6 illustrates the application of the invention to a fume hood sash member as an integrated part of a hood structure, and is particularly adapted for inclusion in a hood structure during the fabricating thereof. In this example the actuating member is in the form of rack 109 illustrated as secured to the sash 10, and adapted to be moved by a drive pinion 110 engaged therewith which, for example, may be directly driven by the motor 37.

The structure mounted on the sash may include one or more switch-actuating abutments 47, disposed to engage suitably positioned and supported micro-switches 45 and 46, with the control circuit therefor being the same as heretofore described. It will be appreciated that the rack member 109 may be disposed in the most convenient location, for example, on the sash edge as illustrated, on the rear face of the sash frame, etc.

It will also be apparent that an additional switch or switches may be provided for actuation by means carried by the rack in the construction of FIG. 6, as well as in the other embodiments illustrated, for effecting an intermediate positioning of the sash member or provide two additional control functions.

Also it may be desirable, in some installations, for example where hydraulic or pneumatic equipment is associated with the fume hood, to provide a corresponding power source instead of an electric motor.

It will be appreciated that the invention enables the material reduction in air requirements and thus in power requirements when the structure is unattended or not in use and at the same time enables the attachments to be readily utilized on most existing fume hood structures as well as incorporated in new structures.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. An actuator mechanism for fume hood structures having an access opening in a wall thereof and a closure structure therefor, including a movable sash member, disposed for movement in said access opening to vary the effective size thereof, comprising a power source mounted on a stationary portion of structure and having a drive pulley, a freely rotatable idler pulley carried by said structure and spaced from said drive pulley, an actuating member, a cable extending between and over said drive and idler pulleys, said actuating member being secured to said cable with the latter extending therefrom to the respective pulleys, with such portion of the cable defining the line of travel of said actuating member for moving the latter in either direction along said line of travel, said actuating member being disposed adjacent an element of said closure structure having a movement, during operation of the latter, in the same direction as that of said actuating member, means connecting said actuating member and the movable element of such closure structure for effecting a movement of such element, and means for controlling said power source to control such element movement.

2. An actuator according to claim 1, wherein said movable element of the closure structure is a cable forming a part of counter-balancing means for the sash member, said securing means being constructed to secure said actuating element to such a cable.

3. An actuator according to claim 1, wherein said movable element of the closure structure is the sash member thereof, said securing means being constructed for securing said actuating member to such a sash member.

4. An actuator according to claim 1, wherein said power source is an electric motor, and the controlling means therefor comprises limit switches disposed in the supply line to said power source and actuatable by means movable along said line of travel in correspondence to movement of said actuating member.

5. An actuator according to claim 4, wherein said limit switch actuating means comprises means disposed on said actuating member.

6. An actuator according to claim 1, wherein said power controlling means includes personnel-actuatable means for actuating said control means to move such a sash member in an opening direction in the presence of personnel, and in closing direction in the absence of personnel.

7. An actuator according to claim 1, wherein said control means includes means for controlling the operation of an exhaust blower on such a fume hood.

8. An actuator according to claim 7, for a fume hood structure provided with a two-speed exhaust blower, wherein said control means is operative to actuate said blower at high speed when such a sash member is in a relatively open position, and at a low speed when such as sash member is in a relatively closed position.

9. An actuator according to claim 8, for a fume hood structure which is to be provided with auxiliary air by an auxiliary air blower, wherein said control means is constructed to actuate such an auxiliary air blower when such a sash member is in a relatively open position and deactuate such air blower when such a sash member is in a relatively closed position.

10. An actuator mechanism for fume hood structures in the form of an attachment which may be mounted on an existing fume hood structure having an access opening in a wall thereof and a closure structure therefor, including a movable sash member, disposed for movement in said access opening to vary the effective size thereof, comprising a base structure, a power source mounted on said base member and having a drive pulley, a freely rotatable idler pulley carried by said base member and spaced from said drive pulley, an actuating member, a cable extending between and over said drive and idler pulleys, said actuating member being secured to said cable with the latter extending therefrom to the respective pulleys, with such portion of the cable defining the line of travel of said actuating member for moving the latter in either direction along said line of travel, said actuating member being adapted to be disposed adjacent an element of said closure structure having a movement, during operation of the latter, in the same direction as that of said actuating member, means for supporting said base structure on such a fume hood structure with said line of travel extending parallel to the line of travel of such an element of the closure structure, means for connecting said actuating member and the movable element of such closure structure for effecting a movement of such element, and means for controlling said power source to control such element movement.

11. An actuator according to claim 10, wherein said power source is an electric motor carried by said base plate, and the controlling means therefor comprises limit switches disposed in the supply line to said power source, said switches being actuatable by means movable along said line of travel in correspondence to movement of said actuating member.

12. An actuator according to claim 10, wherein said limit switch actuating means comprises means disposed on said actuating member.

13. An actuator according to claim 12, wherein said movable element of the closure structure is a cable forming a part of counter-balancing means for the sash member, said securing means being constructed to secure said actuating element to such a cable.

14. An actuator according to claim 12, wherein said movable element of the closure structure is the sash member thereof, said securing means being constructed for securing said actuating member to such a sash member.

15. An actuator according to claim 10, wherein said power controlling means includes personnel-actuatable means for actuating said control means to move such a sash member in an opening direction in the presence of personnel, and in closing direction in the absence of personnel.

16. An actuator according to claim 15, wherein said personnel acutatable switch comprises a floor mat switch actuatable by weight thereon.

17. An actuator according to claim 15, wherein said personnel acutatable switch comprises a floor mat switch actuatable by weight thereon.

18. An actuator according to claim 10, wherein said control means includes means for controlling the operation of an exhaust blower on such a fume hood.

19. An actuator according to claim 18, for a fume hood structure provided with a two-speed exhaust blower, wherein said control means is operative to actuate said blower at high speed when such a sash member is in a relatively open position, and at a low speed when such a sash member is in a relatively closed position.

20. An actuator according to claim 19, for a fume hood structure which is to be provided with auxiliary air by an auxiliary air blower, wherein said control means is constructed to actuate such an auxiliary air blower when such a sash member is in a relatively open position and deactuate such air blower when such a sash member is in a relatively closed position.

* * * * *

UNITED STATES PATENT AND TRADEMARK OFFICE

CERTIFICATE OF CORRECTION

PATENT NO. : 4,150,606
DATED : April 24, 1979
INVENTOR(S) : Laurence Nelson

It is certified that error appears in the above-identified patent and that said Letters Patent are hereby corrected as shown below:

Column 4, line 53 "36" second occurrence should read --37--.

Column 5, line 9 "56" should read --46--.

Signed and Sealed this

*Twenty-second* Day of *April 1980*

[SEAL]

*Attest:*

SIDNEY A. DIAMOND

*Attesting Officer*

*Commissioner of Patents and Trademarks*